United States Patent [19]

Rhodes et al.

[11] 4,448,606

[45] May 15, 1984

[54] MOLYBDENUM-TUNGSTEN BASED ALLOYS CONTAINING HAFNIUM CARBIDE

[75] Inventors: Russell H. Rhodes, Monroeton; James S. Smith, Towanda, both of Pa.; Leslie P. Clare, Colonia Del Valle, Mexico

[73] Assignee: GTE Products Corporation, Stamford, Conn.

[21] Appl. No.: 449,918

[22] Filed: Dec. 15, 1982

[51] Int. Cl.[3] ..... B22F 3/00

[52] U.S. Cl. ..... 75/236; 419/17; 419/31; 419/28

[58] Field of Search ..... 75/236; 419/17, 31, 419/28

[56] References Cited

U.S. PATENT DOCUMENTS 3,000,734 9/1961 Grant et al. ..... 75/236

3,447,921 6/1969 Chang ..... 420/429

*Primary Examiner*—Brooks H. Hunt

*Attorney, Agent, or Firm*—Robert E. Walter

[57] ABSTRACT

A powder metallurgical alloy which comprises a solid solution of molybdenum and from about 10 to about 98 percent by weight tungsten has a dispersed phase of hafnium carbide. The alloy is prepared by mixing powders of hafnium carbide, carbon, molybdenum and tungsten, and subsequently pressing, sintering, and age- or work-hardening.

4 Claims, No Drawings

MOLYBDENUM-TUNGSTEN BASED ALLOYS CONTAINING HAFNIUM CARBIDE

This invention relates to molybdenum-tungsten based alloys having high-temperature strength.

BACKGROUND OF INVENTION

As set forth in U.S. Pat. No. 4,165,982, metallic molybdenum has excellent high-temperature properties, and it is known that molybdenum base alloys containing carbon and alloy elements, such as Ti, Zr, Hf and the like, have better high-temperature strength than that of metallic molybdenum. It is desirable to produce new alloys having improved high-temperature hardness and strengths.

U.S. Pat. No. 3,169,860 to Semchyshen relates to additions of hafnium, carbon, titanium and zirconium to arc melted molybdenum which may include tungsten to form castings.

SUMMARY OF INVENTION

In accordance with the present invention there is provided an improved powder metallurgy alloy consisting essentially of a solid solution of molybdenum and tungsten with from about 10 to about 98 percent by weight tungsten, said alloy having a dispersed phase of precipitated hafnium carbide, wherein hafnium and carbon are present in an amount from about 0.25 to about 3.0 percent by weight and at a ratio of about 12 to about 15 parts of hafnium per part of carbon. According to the process of the present invention, hafnium carbide is added to a mixture of the base metals and subsequently precipitated.

DETAILED DESCRIPTION

Preliminary tests were run on powder metallurgy TMZ, TZC and Mo-HfC and on these same alloys with 25 and 45%W by weight tungsten. TZM alloy consists of 0.4–0.55% by weight Ti, 0.06–0.12% by weight Zr, 0.01–0.04% by weight C and the remainder Mo. TZC alloy consists of 1.02–1.42% by weight Ti, 0.25–0.35% by weight Zr, 0.07–0.13% by weight C with the remainder being molybdenum. Mo-HfC alloy consists of 1.05–1.30% by weight HfC with the remainder being molybdenum.

All were forged to a reduction in height of 75%. The TZM and Mo-HfC alloys were forged satisfactorily but the TZC alloys had edge cracks. Hardness tests, tensile tests and creep tests were made on the alloys with the following results:

TABLE I

Properties of Alloys Forged 75% RIH

| P/M Forged Alloy | $DPH_{10\text{-}kg}$ After 1 hr. at 1500C. | 1316C Tensile Strength, ksi | Min. Creep Rate, %/hr 1204C 48 ksi | Min. Creep Rate, %/hr 1316C 30 ksi |
|---|---|---|---|---|
| TZM | 199 | 69 | .052 | .18 |
| TZM + 25W | 216 | 75 | .058 | .17 |
| TZM + 45W | 254 | 92 | .014 | .051 |
| TZC | 230 | 90 | .021 | .14 |
| TZC + 25W | 240 | 99 | .021 | — |
| TZC + 45W | 281 | 106 | .011 | .12 |
| Mo + HfC | 225 | 85 | .038 | .07 |
| Mo + HfC + 25W | 249 | 92 | .020 | .04 |

TABLE I-continued

Properties of Alloys Forged 75% RIH

| P/M Forged Alloy | $DPH_{10\text{-}kg}$ After 1 hr. at 1500C. | 1316C Tensile Strength, ksi | Min. Creep Rate, %/hr 1204C 48 ksi | Min. Creep Rate, %/hr 1316C 30 ksi |
|---|---|---|---|---|
| Mo + HfC + 45W | 287 | 110 | .008 | .03 |

P/M—powder metallurgy
DPH—Diamond Pyramid Hardness is a test performed with a diamond indenter at room temperature after the material has been heated for one hour at 1500° C.
ksi—Thousand pounds per square inch
RIH—Reduction in Height As seen, the Mo-HfC alloys gave similar strengths but generally lower creep rates than the TZC alloys but were also more forgeable. Strength levels were much improved over TZM. As compared to Mo+HfC alloy, the Mo+HfC +W alloys of the present invention have improved properties.

Another example of improved high-temperature properties of the alloy of the present invention as compared to those of TZM are shown in Table II.

TABLE II

Properties of Powder Metallurgy Alloys

| Alloy (Nominal Composition) | Forged 66% RIH Hardness Stress Relieved DPH (10-kg) | Stress Relieved Rc | After 1 hr at 1500C, Rc | Tensile Strength, ksi 1316C |
|---|---|---|---|---|
| TZM | 319 | 30 | 17 | 65 |
| Mo + 1.2HfC | 357 | 31 | 30 | 77 |
| (Mo − 48W) + 0.83HfC | 508 | 43 | 44 | 128 |

Rc - Rockwell C

The alloy of the present invention is consolidated by the powder metallurgical method in which the powders are mixed, pressed into desired form, and sintered in a reducing atmosphere such as hydrogen or in vacuum to 92% dense or greater.

In the present invention, the base metal powder is preferably a combination of molybdenum and tungsten metals in the desired proportions depending on desired high-temperature properties. If a molybdenum-tungsten base metal material is being made, the oxides of the two metals are preferably co-reduced so that alloying takes place between the two metals. From about 0.25 to about 3 percent, preferably from about 0.5 to about 2 percent of hafnium carbide based on the combined weight of molybdenum and tungsten is mixed with the resulting coreduced powder.

After blending, the powder mix is pressed in the desired form and sintered at temperatures in the range of 1800–2300 degrees Celsius. The sintering step also serves as a solution treatment in that during this step the carbon and hafnium are believed to dissolve in the base material in atomic form.

During the blending of hafnium carbide with the molybdenum-tungsten powder carbon may be added to reduce the amount of oxygen during sintering. Any carbon additions are typically less than about 0.05 present by weight. After sintering, the hafnium is preferably present in an amount from about 12 to about 15 parts by weight hafnium per part of carbon and preferably at the stoichiometric amount of about 15 parts of hafnium per part of carbon. The desirable amount of oxygen in the sintered alloy is below 150 parts per million.

The desired high-temperature properties, that is high strength and hardness, are not realized until the hafnium carbide is precipitated in a very finely dispersed second phase. This can be done by aging for a long period of time at a relatively low temperature. However, the material is normally aged at an accelerated rate by working at temperatures below the recrystallization temperatures, preferably from about 1000 to 1500 degrees Celsius, depending on the alloy. Upon working, the hardness increases rapidly due to precipitation of hafnium carbide. The work hardening is retained at higher temperatures because the precipitate retards recrystallization.

Working may be performed by any technique such as forging, swaging, rolling, or extrusion. When forging is used, height reductions of greater than about 50% are desirably employed. The preferred alloy of the present invention has tungsten present in an amount from about 20 to 60 percent by weight.

The combined weight of hafnium and carbon in the alloy is from about 0.25 to about 3 percent and preferably from about 0.5 to about 2 percent with weight percent being based on the combined weight of molybdenum and tungsten. Subsequently all the hafnium and carbon is present in the grains and not at the grain boundaries. Preferably the hafnium and carbon are present as hafnium carbide as a precipitated dispersed phase.

EXAMPLE

About 124 kilograms of pure molybdenum oxide powder was throughly mixed with about 85 killograms of pure tungsten oxide powder to form a uniform powder blend. The resulting powder was reduced to metal alloy powder by a two stage reduction. In the first stage, the oxide was subjected to a dissociated ammonia reducing atmosphere at a temperature of 612° C. In the final reduction stage, the powder mixture is heated to 1149° C. in a hydrogen atmosphere to form a metal powder consisting essentially of about 52% by weight molybdenum and 48tungsten. To 50 kilogram of the molybdenum-tungsten blended powder, 0.4185 kilogram (0.83%) hafnium carbide and 0.005 kilogram (0.01%) carbon was added. After thoroughly blending the additives and the molybdenum-tungsten powder, the resulting powder was isostatically pressed into green billets approximately 3 inches in diameter by 4 inches. The billets were pre-sintered in dry hydrogen at 1200° C. and sintered in vacuum to a density of 92% of theoretical. The billet was heated in a gas fired furnace and was forged about 66% reduction in height which induced precipitation hardening. The resulting forged alloy had the properties reported in TABLE II. We claim:

1. A powder metallurgy alloy consisting essentially of a solid solution of molybdenum and from about 10 to about 98 percent by weight tungsten, said alloy having a dispersed phase of precipitated hafnium carbide wherein hafnium and carbon are present in an amount from about 0.25 to about 3 percent by weight and in a ratio of about 12 to about 15 parts of hafnium per part of carbon.

2. A powder metallurgy alloy according to claim 1 wherein said tungsten is present in an amount from about 20 to about 60 percent by weight.

3. A powder metallurgy alloy according to claim 1 wherein said hafnium is present in an amount of about 15 parts by weight hafnium per part of carbon.

4. A process for producing a molybdenum-tungsten based alloy comprising preparing a mixture consisting essentially of the oxides of molybdenum and tungsten, said mixture comprising from about 10 to 98 percent by weight tungsten based on the combined weight of tungsten and molybdenum, coreducing said oxide mixture in a hydrogen atmosphere to give an intimate mixture of molybdenum and tungsten powder, adding and blending hafnium carbide with said mixture in an amount sufficient for hafnium carbide to be from about 0.25 to about 3 percent by weight of a resulting mixture, pressing and sintering said resulting mixture at a temperature of from 1800 to about 2300 degrees Celsius for a sufficient period of time to dissolve at least a portion of said hafnium carbide, working said sintered alloy at a temperature below the recrystallization temperature of the resulting alloy to precipitate a dispersed phase of hafnium carbide.

* * * * *